US010378867B2

(12) United States Patent
Couch et al.

(10) Patent No.: US 10,378,867 B2
(45) Date of Patent: Aug. 13, 2019

(54) CARTRIDGE

(71) Applicant: Count-On Tools, Inc., Gainesville, GA (US)

(72) Inventors: Curtis Larry Couch, Santa Rosa Beach, FL (US); Jackson T. Strayhorn, Cleveland, GA (US); James C. Cash, Gainesville, GA (US); Alexis Z. Shook, Alto, GA (US)

(73) Assignee: COUNT-ON TOOLS, INC., Gainesville, FL (US)

( * ) Notice: Subject to any disclaimer, the term of this patent is extended or adjusted under 35 U.S.C. 154(b) by 0 days.

(21) Appl. No.: 16/169,586

(22) Filed: Oct. 24, 2018

(65) Prior Publication Data

US 2019/0120602 A1 Apr. 25, 2019

Related U.S. Application Data

(60) Provisional application No. 62/576,850, filed on Oct. 25, 2017.

(51) Int. Cl.
*F42B 12/06* (2006.01)
*F42B 12/74* (2006.01)
(Continued)

(52) U.S. Cl.
CPC ..... *F42B 12/06* (2013.01); *F42B 10/46* (2013.01); *F42B 12/36* (2013.01); *F42B 12/74* (2013.01)

(58) Field of Classification Search
CPC ..... F42B 12/16; F42B 12/06; F42B 12/54; F42B 7/10; F42B 10/46
(Continued)

(56) References Cited

U.S. PATENT DOCUMENTS 280,067 A 6/1883 Mulvey
1,447,478 A 3/1923 Koshollek et al.
(Continued)

FOREIGN PATENT DOCUMENTS

FR 2602042 A1 1/1988
FR 2925150 A1 * 6/2009 ..... F42B 12/54
WO 2015/022377 A1 2/2015

OTHER PUBLICATIONS

"Subsonic Reloading the Lehigh Defense 300 Blackout 168 gr Controlled Fracturing Bullet, Part II" [online], AP2020 Outdoors Adventures. [Published on Aug. 9, 2016]. Retrieved from the internet: <https://www.youtube.com/watch?v=fkptDblf53c>, 1 page.
(Continued)

*Primary Examiner* — Reginald S Tillman, Jr.
(74) *Attorney, Agent, or Firm* — Rankin, Hill & Clark LLP

(57) ABSTRACT

A cartridge includes a case, a primer, and propellant disposed in the case. The cartridge also includes a projectile at least partially received in the case. The projectile includes a main body that defines a counter-bore and a through-bore and a piston received in the main body. The piston includes a base, a head, and a shaft. The projectile defines a non-deployed state in which the base is entirely received within the counter-bore, a first portion of the shaft is received in the counter-bore and a second portion of the shaft is received in the through-bore, and the head is received in the through-bore. The projectile also defines a deployed state in which the base is received within the counter-bore and at least part of the head is not received in the through-bore.

20 Claims, 15 Drawing Sheets

(51) Int. Cl.
*F42B 10/46* (2006.01)
*F42B 12/36* (2006.01)

(58) Field of Classification Search
USPC ..... 102/520, 512, 507, 439, 503, 518; 244/3.23
See application file for complete search history.

(56) References Cited

U.S. PATENT DOCUMENTS

| | | | | | |
|---|---|---|---|---|---|
| 2,324,346 | A | | 7/1943 | Albree | |
| 2,493,938 | A | | 1/1950 | Albree | |
| 2,617,359 | A | * | 11/1952 | Van Horn | A61M 5/282 102/512 |
| 2,620,190 | A | * | 12/1952 | Bean | F42B 6/003 102/513 |
| 3,086,467 | A | * | 4/1963 | Gallagher | F42B 10/52 244/3.1 |
| 3,181,507 | A | | 5/1965 | Dannebaum | |
| 3,672,304 | A | | 6/1972 | Rogers et al. | |
| 4,559,876 | A | * | 12/1985 | Bocker | F42B 10/46 102/501 |
| 4,597,333 | A | * | 7/1986 | Bocker | F42B 12/625 102/489 |
| 4,964,341 | A | * | 10/1990 | Hebert | F42B 10/46 102/439 |
| D357,700 | S | | 4/1995 | Oka | |
| D389,221 | S | | 1/1998 | Borg | |
| D456,480 | S | | 4/2002 | Quinsa et al. | |
| D472,600 | S | | 4/2003 | Dehaan | |
| D480,422 | S | | 10/2003 | Belmondo | |
| 6,776,101 | B1 | * | 8/2004 | Pickard | F42B 12/34 102/507 |
| 6,887,008 | B2 | | 5/2005 | Kitao et al. | |
| D621,468 | S | | 8/2010 | Nilsson | |
| 7,814,837 | B2 | | 10/2010 | Sauvestre | |
| D646,179 | S | | 10/2011 | Jansen | |
| D672,006 | S | | 12/2012 | Mok | |
| D708,291 | S | | 7/2014 | Pierce | |
| D751,167 | S | | 3/2016 | Chua et al. | |
| 9,354,027 | B2 | | 5/2016 | Flint et al. | |
| D768,802 | S | | 10/2016 | Bowers | |
| D770,005 | S | | 10/2016 | Christiansen et al. | |
| 9,551,555 | B2 | | 1/2017 | Flint et al. | |
| D780,876 | S | | 3/2017 | Boatright | |
| D791,266 | S | | 7/2017 | Burczynski et al. | |
| D813,975 | S | | 3/2018 | White | |
| D821,536 | S | | 6/2018 | Christiansen et al. | |
| 2003/0019385 | A1 | | 1/2003 | LeaSure et al. | |
| 2010/0263565 | A1 | | 10/2010 | Hugus et al. | |
| 2018/0224249 | A1 | | 8/2018 | Carbone et al. | |

OTHER PUBLICATIONS

"Count on 160gr ASAT—Test Results" [online]. Snipercentral.com. [Retrieved on Dec. 8, 2018]. Retrieved from he internet: <http://www.snipercentral.com/count-on-160gr-asat-test-results/> , 4 pages.

"Lehigh Defense 170gr 300 Blackout Controlled Fracturing" [online]. Graham Baates. [Published on May 13, 2016]. Retrieved from the internet: <https://www.youtube.com/watch?v=EKbb59WwOJM> , 1 page.

U.S. Notice of Allowance from U.S. Appl. No. 29/623,574, dated Dec. 28, 2018, 21 pages.

International Search Report/Written Opinion, International Application No. PCT/US2018/057349 dated Jan. 18, 2019, 12 pages.

U.S. Notice of Allowance dated May 1, 2019, U.S. Appl. No. 29/623,597, 35 pages.

U.S. Notice of Allowance dated Mar. 13, 2019 from U.S. Appl. No. 29/623,574, 14 pages.

* cited by examiner

CARTRIDGE

BACKGROUND

Cartridges, and more particularly projectiles have been discharged from firearms for many years. However, the development of cartridges and projectiles has not advanced over time to provide for a projectile that does not over-penetrate a target without sufficient energy transfer.

Accordingly, a more advanced cartridge and projectile is needed.

SUMMARY

In view of the foregoing, a projectile includes a main body that includes a tip and a tail disposed at opposite ends of the main body. The main body defines a counter-bore that extends from the tail toward the tip so as to define a piston axis and a through-bore that extends from the tip toward the tail along the piston axis. The counter-bore defines a counter-bore diameter and the through-bore defines a through-bore diameter. The counter-bore diameter is not equal to the through-bore diameter. The projectile also includes a piston received in the main body.

The piston includes a base and a head disposed at opposite ends thereof. The piston also includes a shaft with a first portion and a second portion that cooperate to connect the base and the head with one another. The projectile defines a non-deployed state in which the base is entirely received within the counter-bore, the first portion of the shaft is received in the counter-bore and the second portion of the shaft is received in the through-bore, and the head is received in the through-bore. The projectile also defines a deployed state in which the base is entirely received within the counter-bore, the first portion of the shaft and the second portion of the shaft are not received in the counter-bore, and at least part of the head is not received in the through-bore.

According to an aspect, a cartridge includes a case including a first end and a second end, a primer disposed in the case at the first end, and propellant disposed in the case between the primer and the second end. The cartridge also includes a projectile at least partially received in the case at the second end. The projectile includes a main body with a tip and a tail disposed at opposite ends of the main body. The main body defines a counter-bore that extends from the tail toward the tip so as to define a piston axis and a through-bore that extends from the tip toward the tail along the piston axis. The counter-bore defines a counter-bore diameter and the through-bore defines a through-bore diameter. The counter-bore diameter is not equal to the through-bore diameter.

The projectile also includes a piston received in the main body. The piston includes a base and a head disposed at opposite ends thereof. The piston also includes a shaft with a first portion and a second portion that cooperate to connect the base and the head with one another. The projectile defines a non-deployed state in which the base is entirely received within the counter-bore, the first portion of the shaft is received in the counter-bore and the second portion of the shaft is received in the through-bore, and the head is received in the through-bore. The projectile also defines a deployed state in which the base is entirely received within the counter-bore, and at least part of the head is not received in the through-bore.

DETAILED DESCRIPTION

Figure 1A:
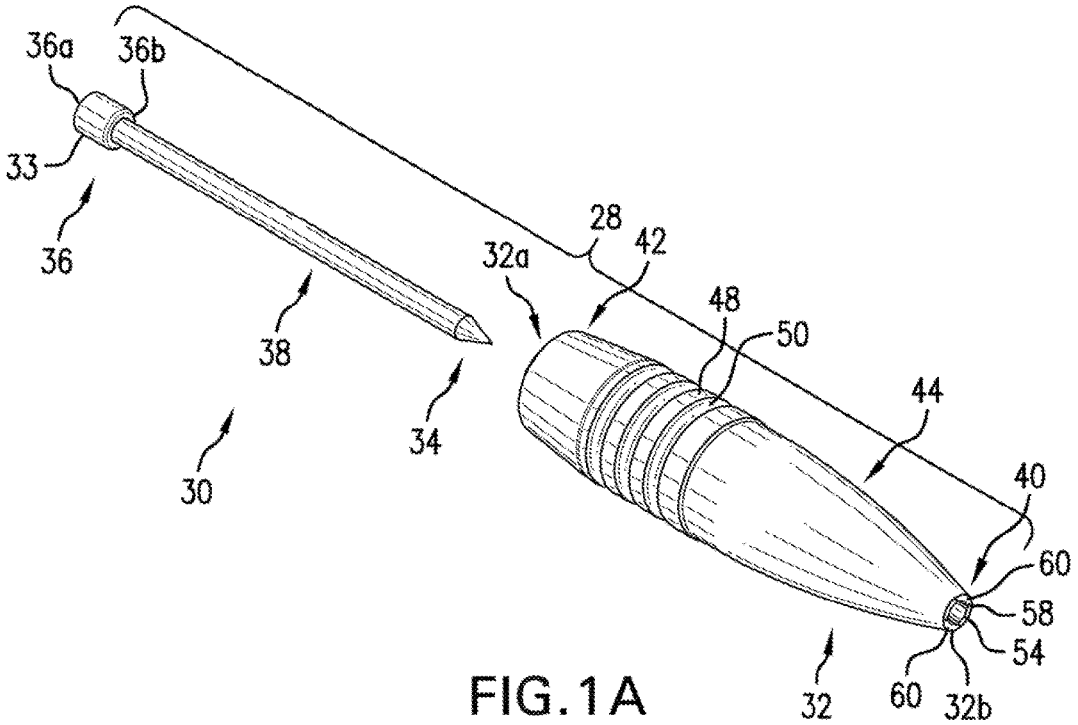
FIG. 1A is an exploded top perspective view of a rifle projectile.
Figure 1B:
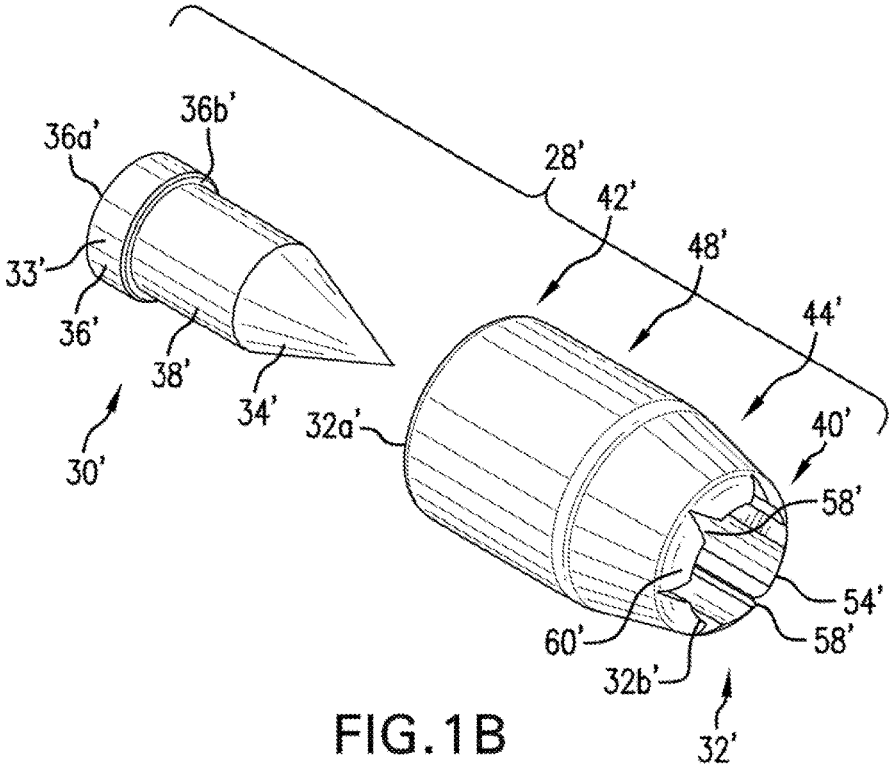
FIG. 1B is an exploded top perspective view of a handgun projectile.
Figure 2A:
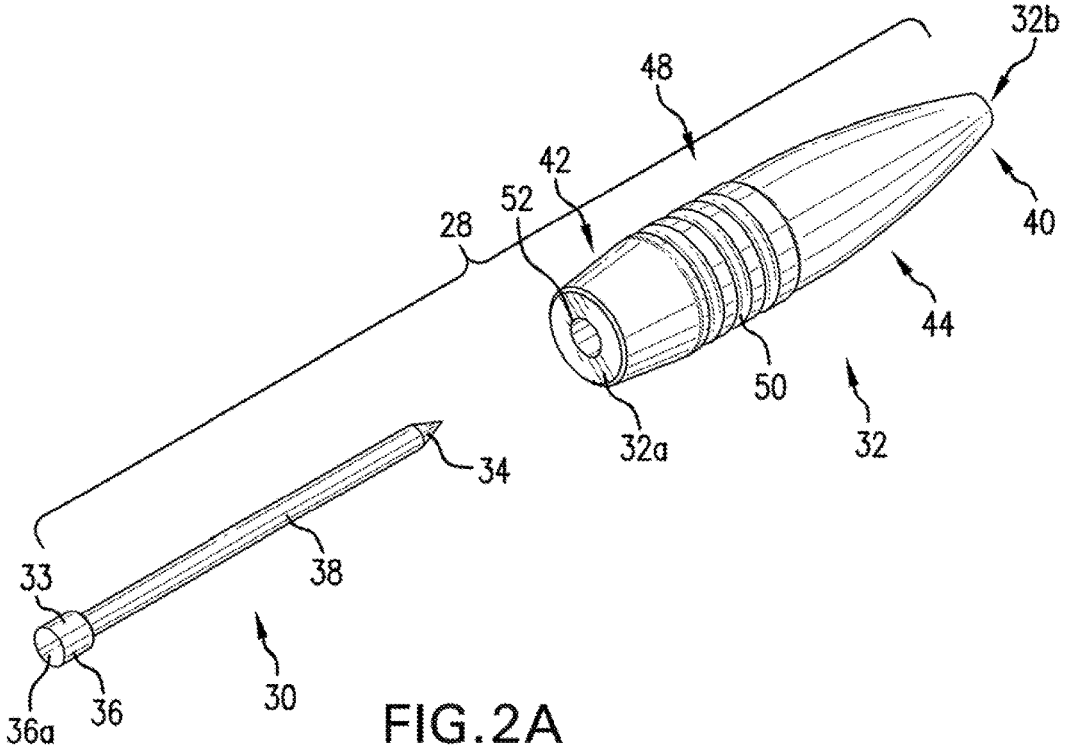
FIG. 2A is an exploded bottom perspective view of the rifle projectile.
Figure 2B:
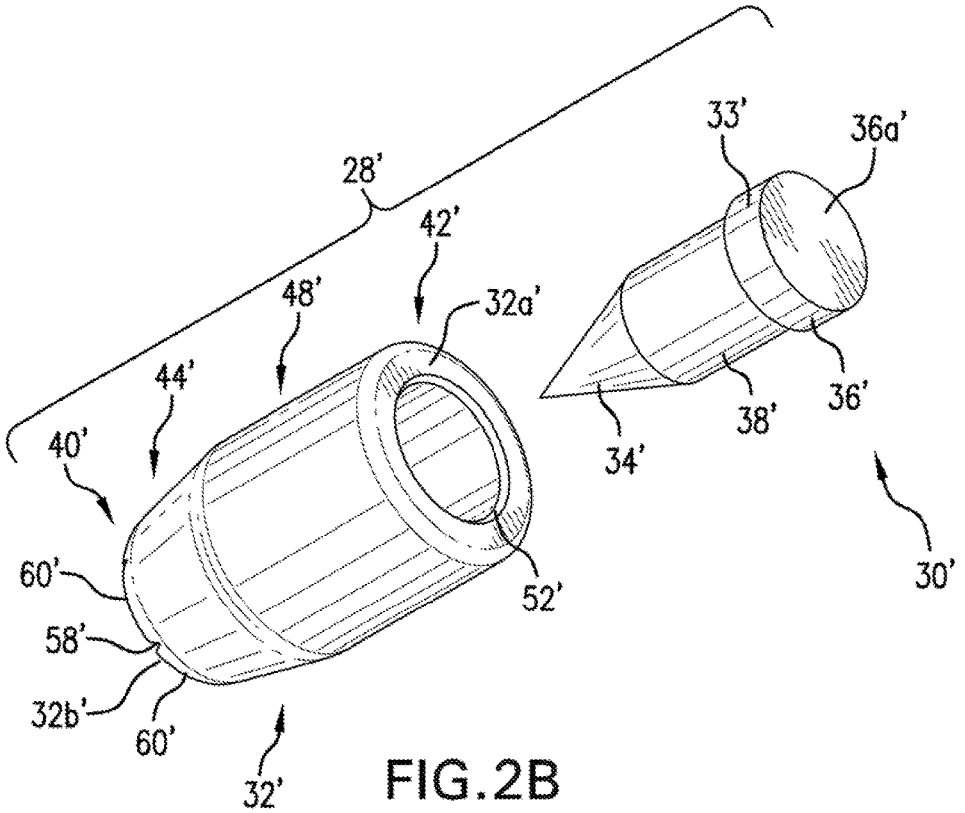
FIG. 2B is an exploded bottom perspective view of the handgun projectile.
Figure 3A:
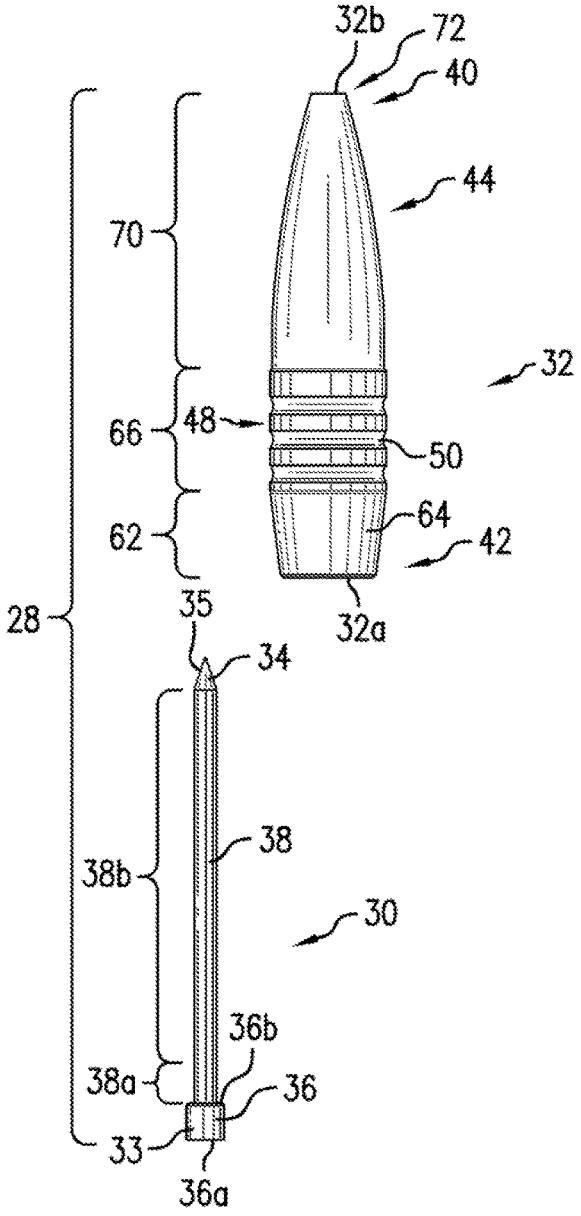
FIG. 3A is an exploded elevational view of the rifle projectile.
Figure 3B:
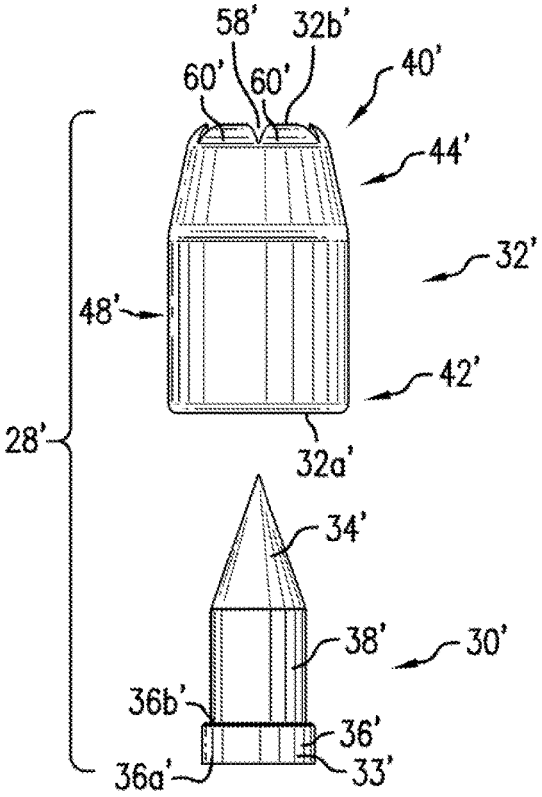
FIG. 3B is an exploded elevational view of the handgun projectile.
Figure 4A:
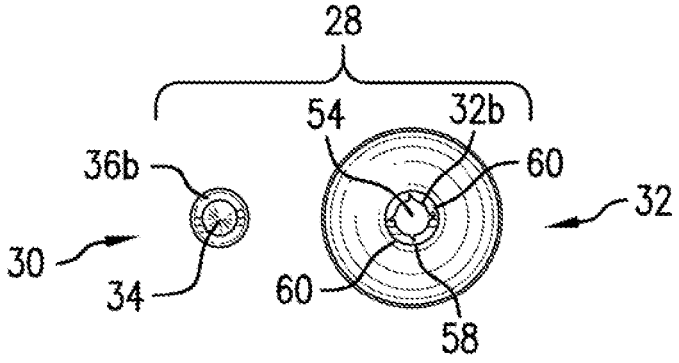
FIG. 4A is an exploded top plan view of the rifle projectile.
Figure 4B:
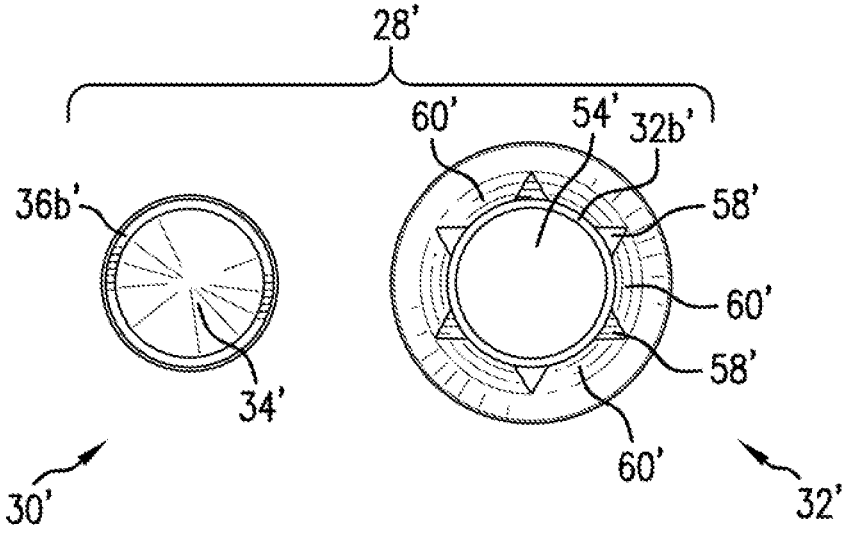
FIG. 4B is an exploded top plan view of the handgun projectile.
Figure 5A:
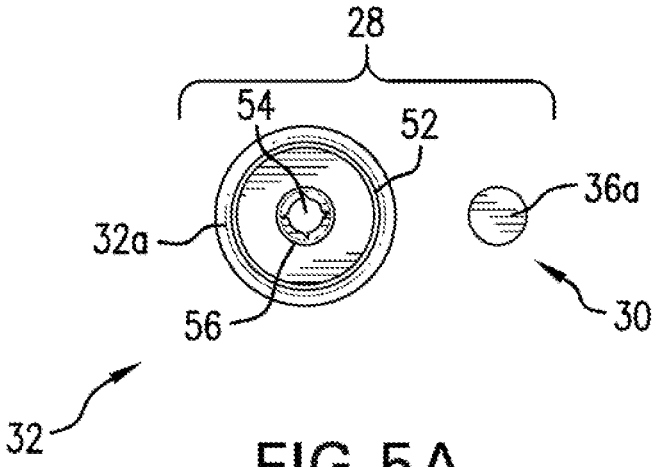
FIG. 5A is an exploded bottom plan view of the rifle projectile.
Figure 5B:
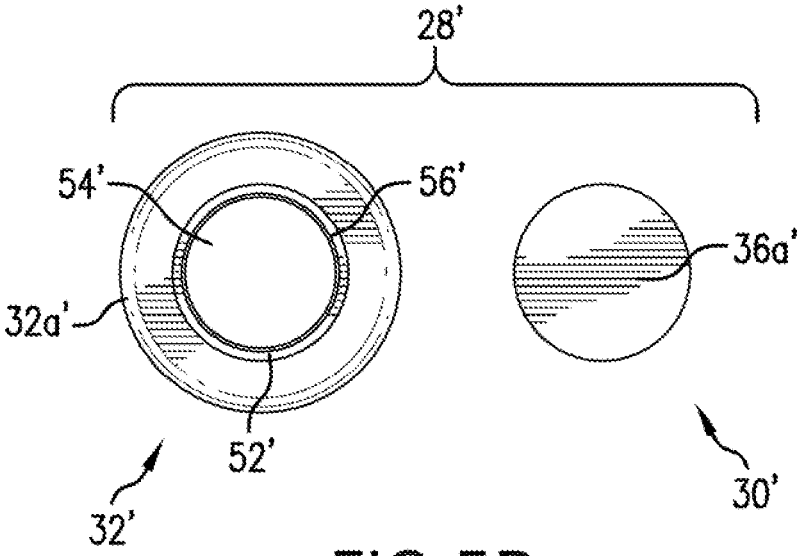
FIG. 5B is an exploded bottom plan view of the handgun projectile.
Figure 6A:
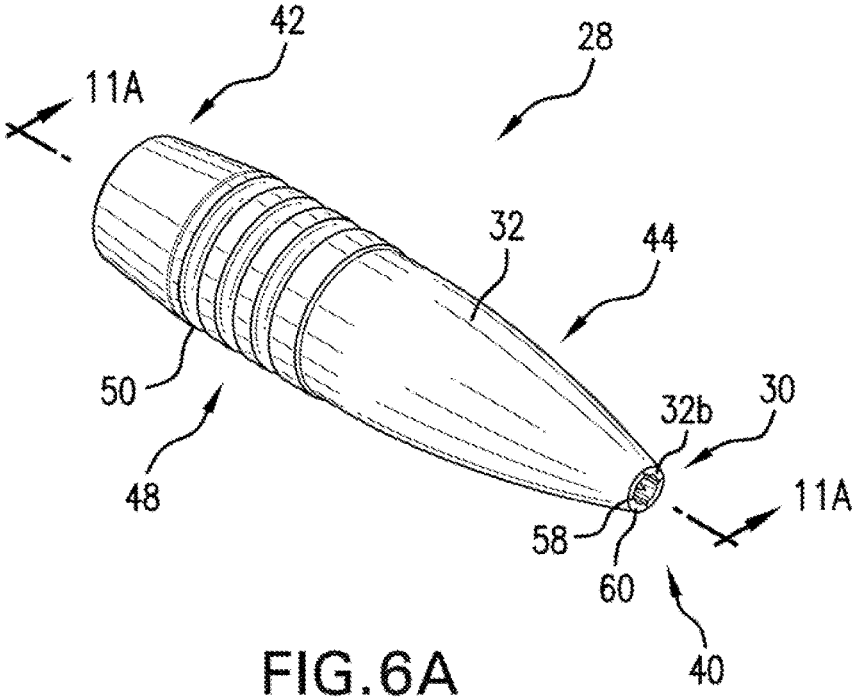
FIG. 6A is a top perspective view of the rifle projectile in a non-deployed state.
Figure 6B:
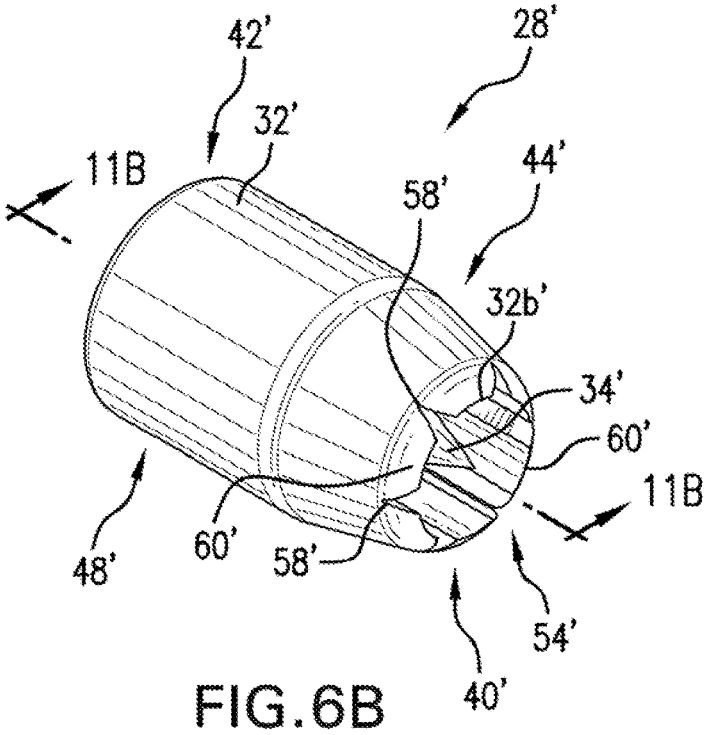
FIG. 6B is a top perspective view of the handgun projectile non-deployed state.
Figure 7A:
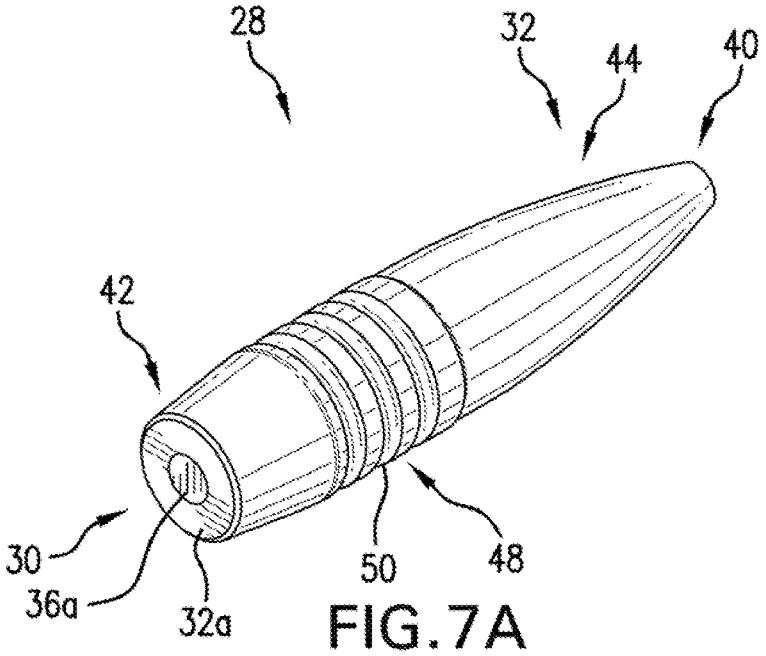
FIG. 7A is a bottom perspective vie of the projectile in the non-deployed state.
Figure 7B:
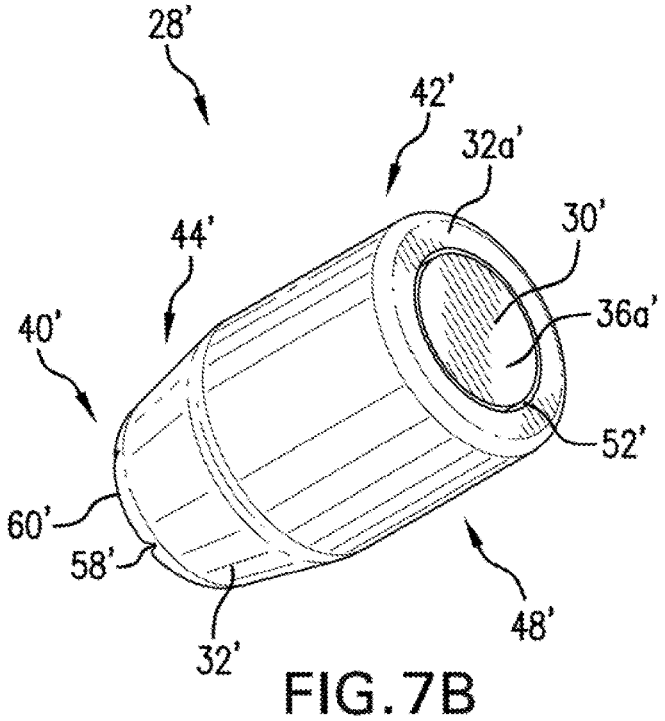
FIG. 7B is a bottom perspective view of the handgun projectile in the non-deployed state.

Initially, it is noted that the present disclosure includes FIGS. 1A-16B. It will be understood that the "A" drawings (e.g., FIG. 1A, 2A, 3A, etc.) illustrate a rifle projectile 28 and/or rifle cartridge 20 that would primarily be discharged from a rifle 2, whereas the "B" drawings (e.g., FIG. 18, 28, 3B, etc.) illustrate a handgun projectile 28' and/or handgun cartridge 20' that would primarily be discharged from a handgun 2'.

As would be understood to one of ordinary skill in the art, rifle cartridges and rifle projectiles are typically longer than a handgun cartridges and handgun projectiles, respectively. However, unless otherwise noted, the "A" drawings and "B" drawings contain similar components. Further, when a Figure is referenced in the present disclosure without an express indication to the drawing being either an "A" or "B" figure, it will be understood that the discussion is applicable to both the "A" figure and the "B" figure.

Figure 8A:
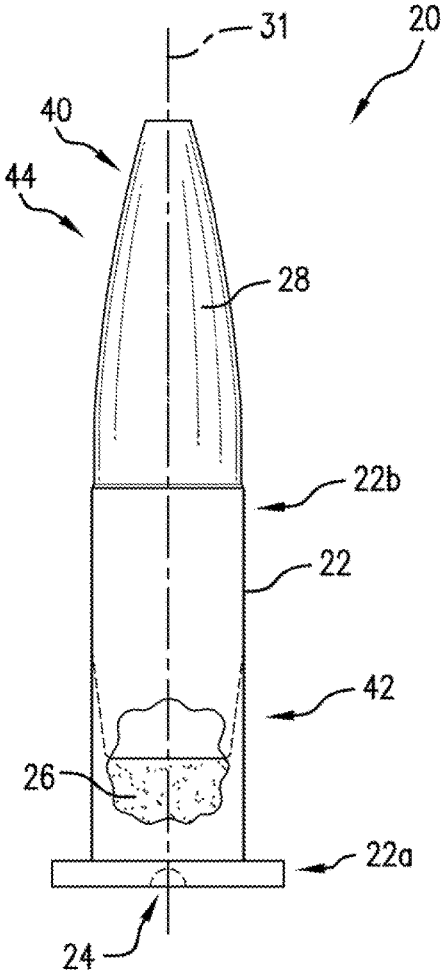
FIG. 8A is an elevational view of a riff cartridge with the projectile in the non-deployed state.
Figure 8B:
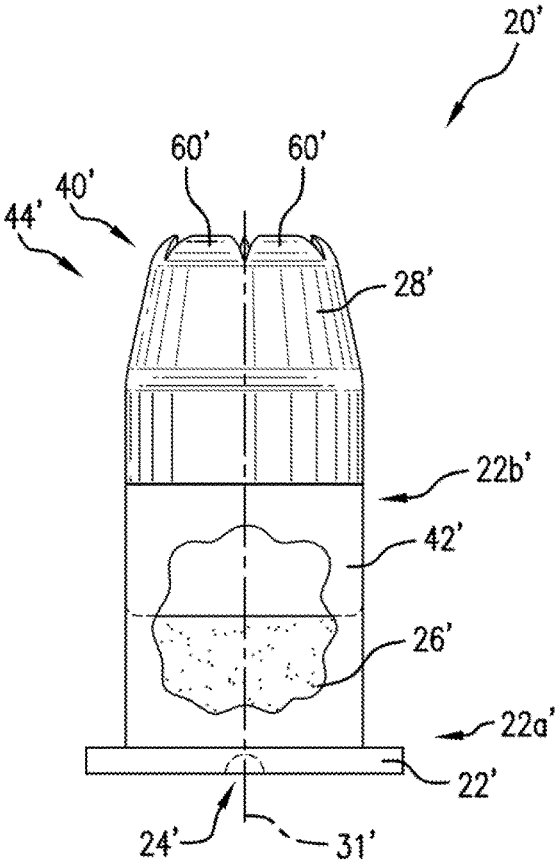
FIG. 8B is an elevational view of a handgun cartridge with the handgun projectile in the non-deployed state.
Figure 9A:
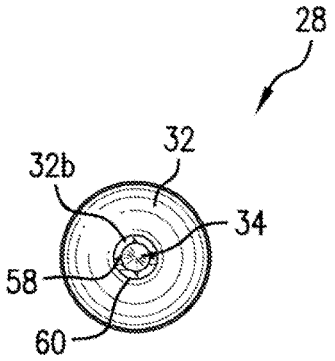
FIG. 9A is a top plan view of the rifle projectile in the non-deployed state.
Figure 9B:
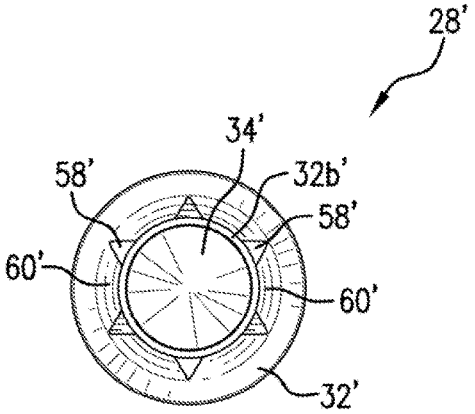
FIG. 9B is a top plan view of the handgun projectile in the non-deployed state.
Figure 10A:
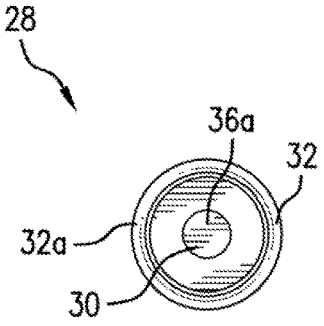
FIG. 10A is a bottom plan view of the rifle projectile in the non-deployed state.
Figure 10B:
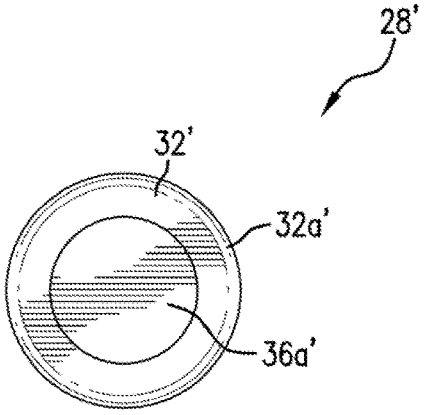
FIG. 10B is a bottom plan view of the handgun projectile in the non-deployed state.

Attention is first directed to FIG. 8 which illustrates a cartridge 20, 20'. The cartridge 20, 20' includes a case 22, 22', a primer 24, 24', propellant 26, 26', and a projectile 28, 28'. As is known in the art, the case 22, 22' is a type of ammunition packaging that contains the primer 24, 24', the propellant 26, 26', and the projectile 28, 28' together. The primer 24, 24' may include shock-sensitive chemicals that subsequently ignite the propellant 26, 26'. For reference, the propellant 26, 26' is many times referred to as smokeless gunpowder. The case 22, 22' includes a first end 22*a*, 22*a'* and a second end 22*b*, 22*b'*.

The primer 24, 24' is disposed in the case 22, 22' at the first end 22*a*, 22*a'* and the propellant 26, 26' is disposed in the case 22, 22' between the primer 24, 24' and the second end 22*b*, 22*b'*. Further, the projectile 28, 28' is at least partially received in the case 22, 22' at the second end 22*b*, 22*b'*. The cartridge 20, 20' can be a high energy shell with a low penetrating projectile 28, 28' for all small arm including rifle calibers up to .50 caliber.

Figure 11A:
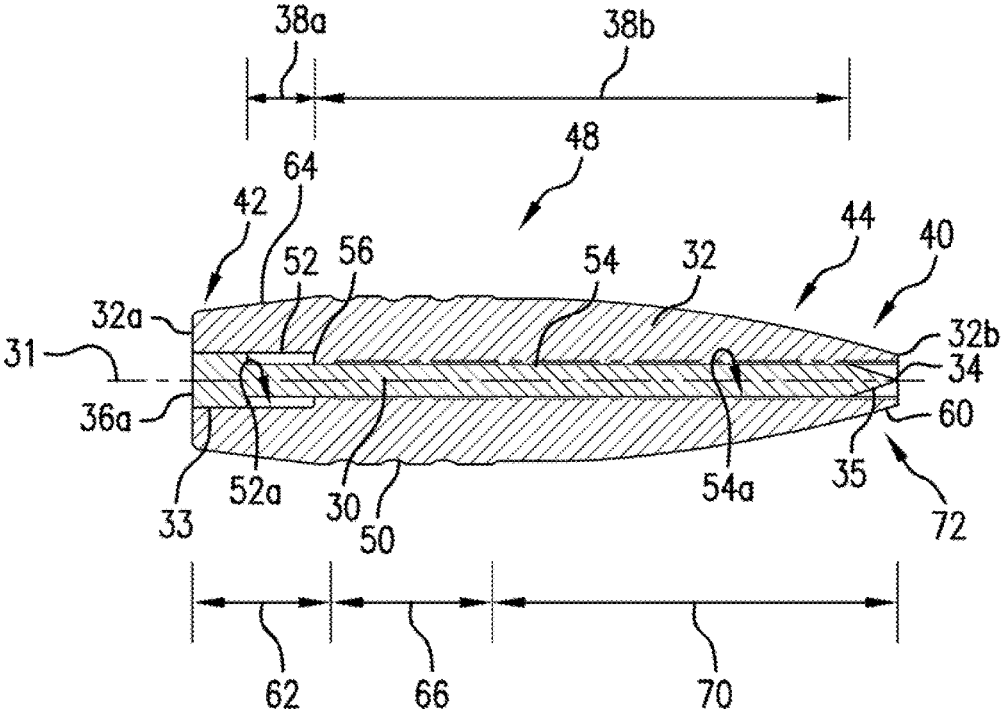
FIG. 11A is a sectional view along lines 11A-11A of FIG. 6A of the rifle projectile in the non-deployed state.
Figure 11B:
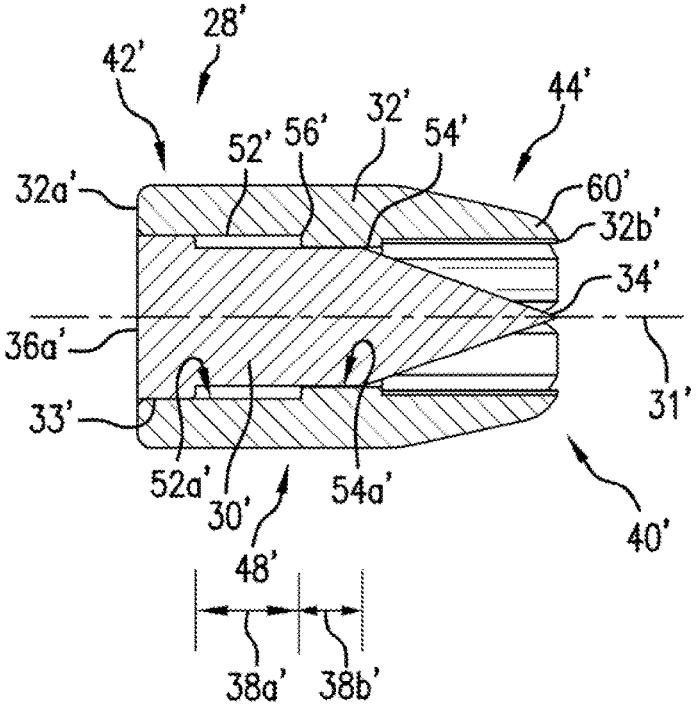
FIG. 11B is a sectional view along lines 11B-11B of FIG. 6B of the handgun projectile in the non-deployed state.
Figure 15A:
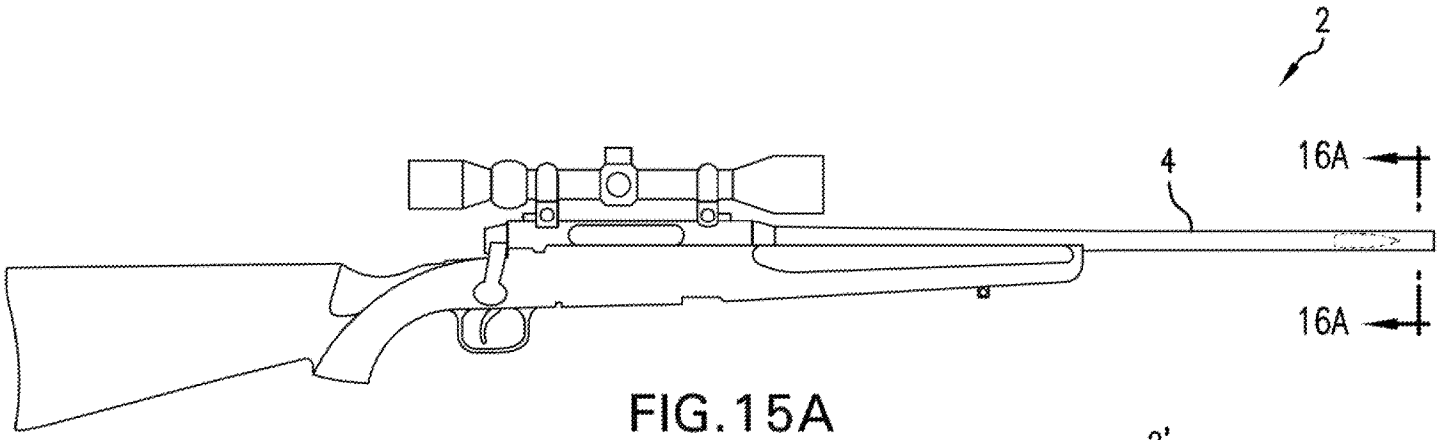
FIG. 15A is an elevational view of a firearm containing the projectile.
Figure 15B:
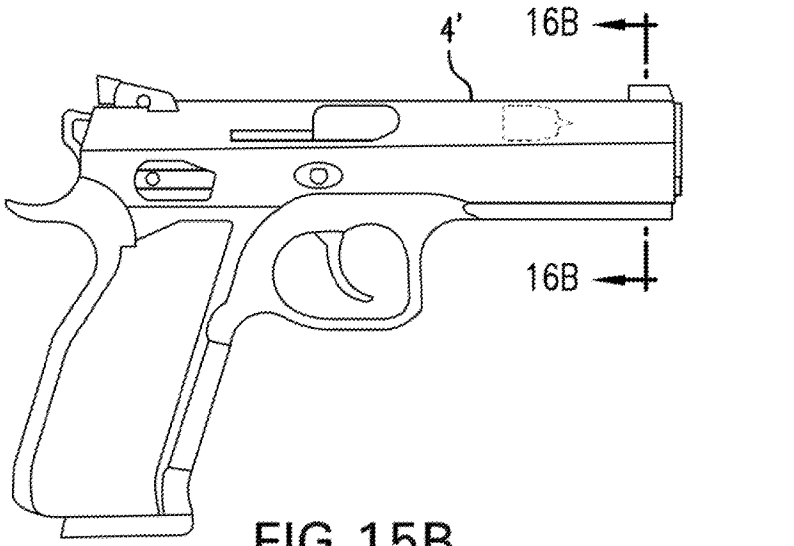
FIG. 15B is an elevational view of an alternative firearm containing the projectile.

Initially, the cartridge 20, 20' is loaded into a firing chamber of a firearm 2, 2' as shown in FIG. 15. Without limitation, the firearm could be any number of types of firearms, including, for example, a rifle 2 or a handgun 2'. Further, the firearm 2, 2' includes a barrel 4, 4' as is known in the art. The projectile 28, 28', is in a non-deployed state as shown by FIGS. 8 and 11. However, when the primer 24, 24' is struck by a firing pin of the firearm 2, 2', the primer 24, 24' rapidly burns and ignites the propellant 26, 26'. Ignition of the propellant 26, 26' causes a rapid expansion of gases which causes the projectile 28, 28' to be expelled from the case 22, 22'.

Figure 12A:
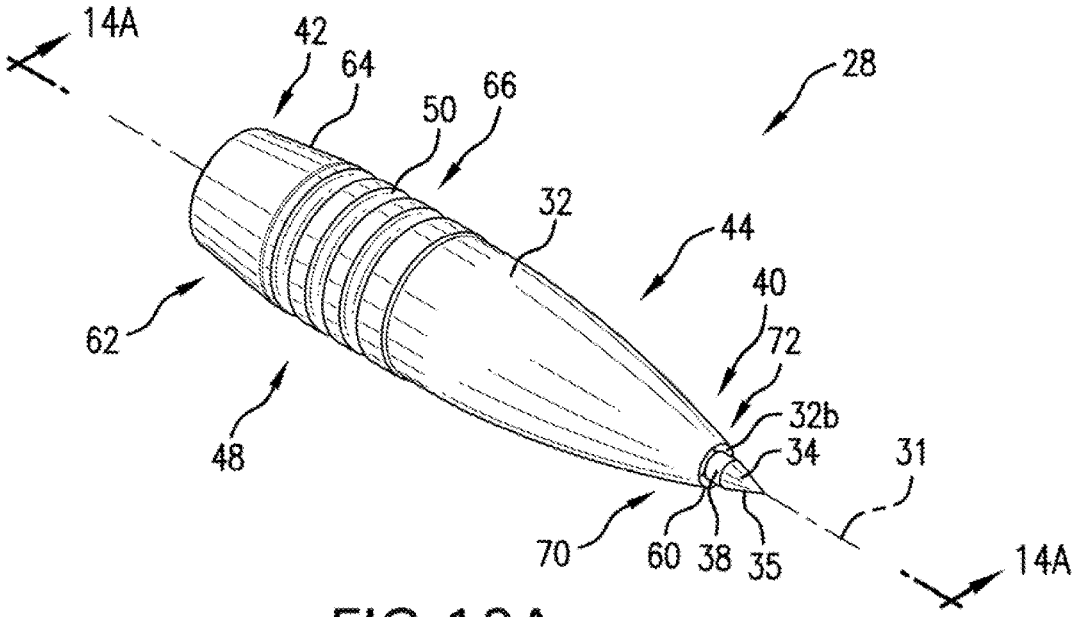
FIG. 12A is a perspective view of the rifle projectile in a deployed state.
Figure 12B:
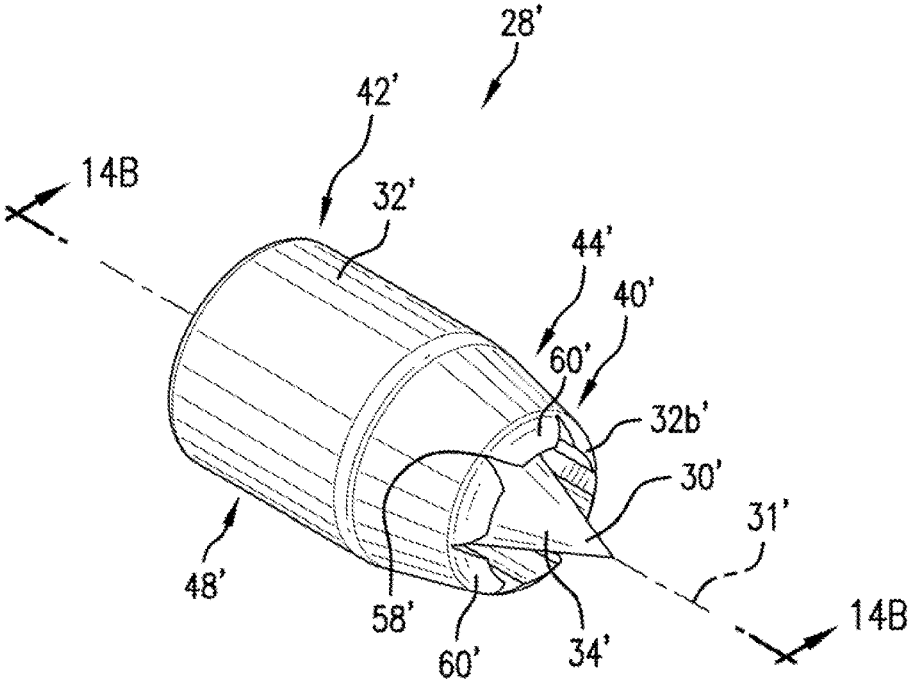
FIG. 12B is a perspective view of the handgun projectile in a deployed state.
Figure 13A:
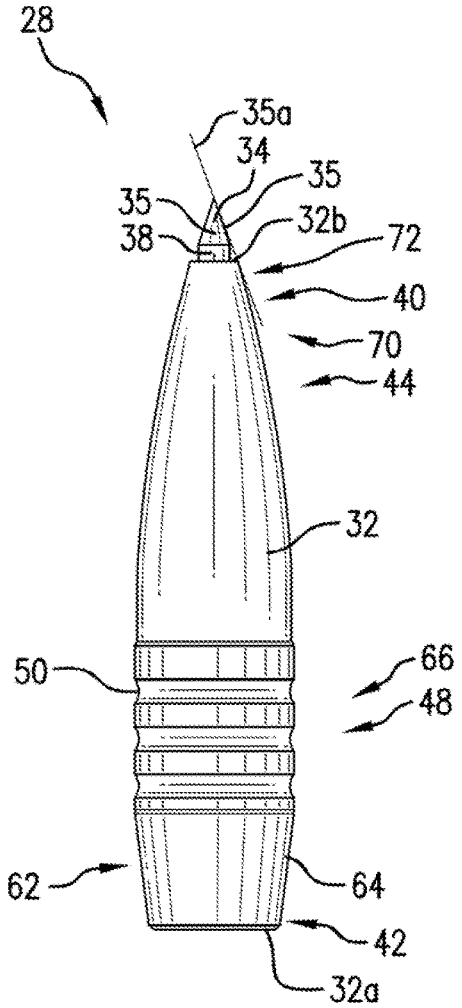
FIG. 13A is an elevational view of the rifle projectile of the projectile in the deployed state.
Figure 13B:
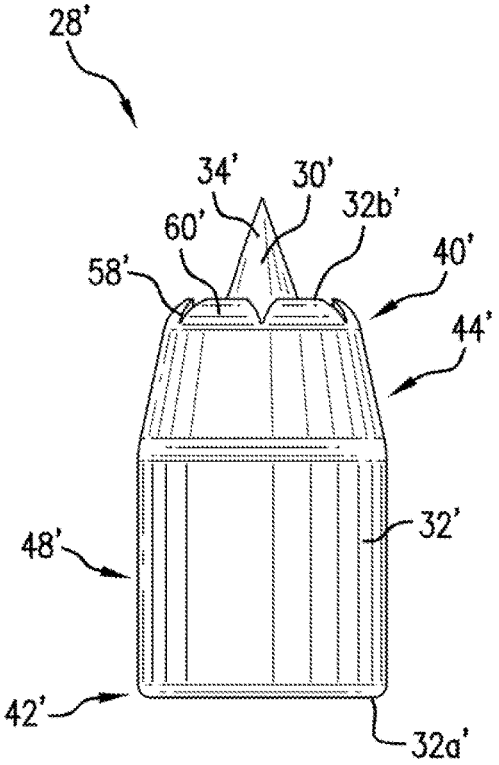
FIG. 13B is an elevational view of the handgun projectile of the handgun projectile in the deployed state.
Figure 14A:
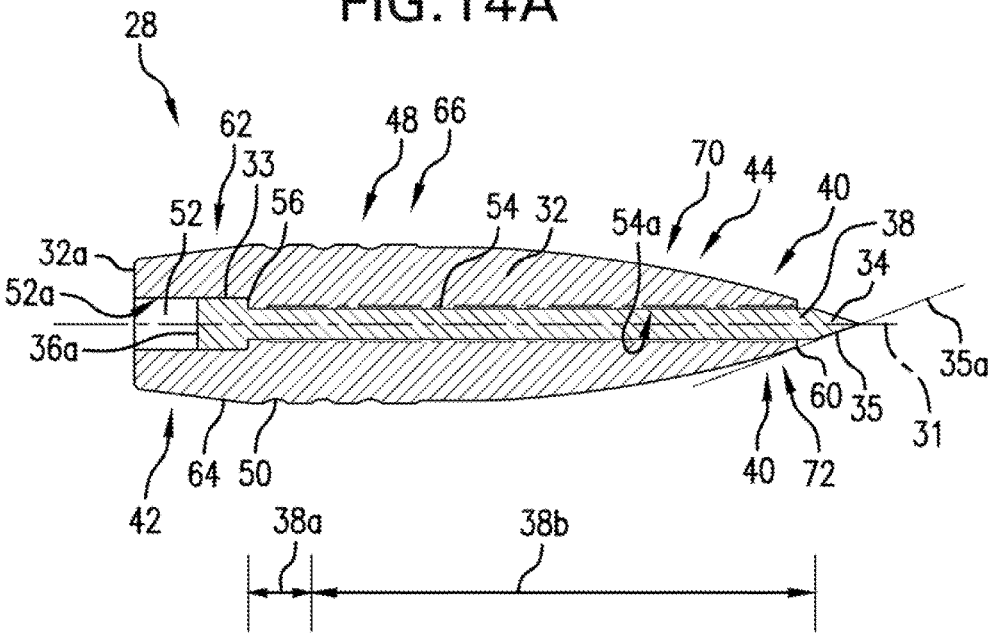
FIG. 14A is a sectional view along lines 14A-14A of FIG. 12A.
Figure 14B:
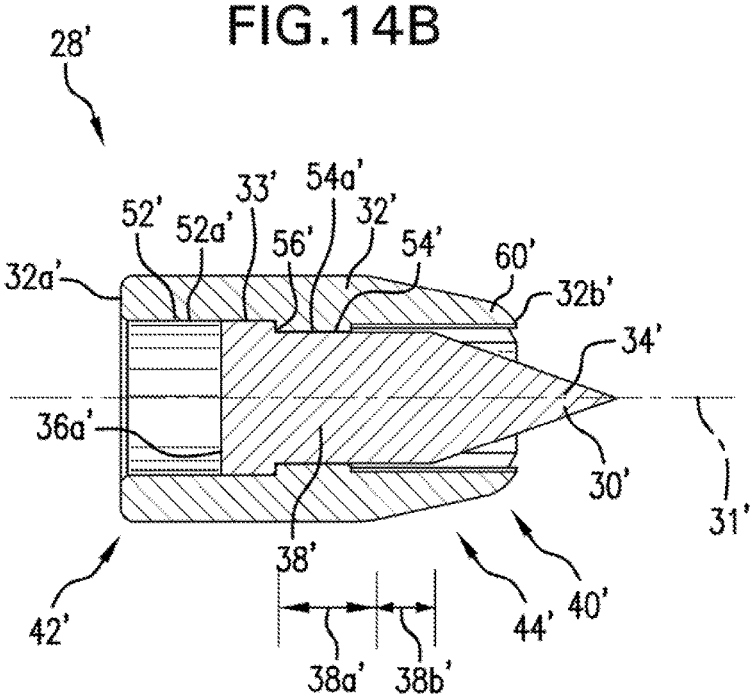
FIG. 14B is a sectional view along lines 148-14B of FIG. 12B.

After the projectile 28, 28' is expelled from the case 22, 22', the projectile 28, 28' leaves the firing chamber and travels through the barrel 4, 4' of the firearm 2, 2' and is in a deployed state as shown by FIGS. 12-14. This is in contrast to FIGS. 6-11, which illustrate the projectile 28, 28' and/or cartridge 20, 20' in the non-deployed state. The non-deployed and deployed states will be discussed in more detail hereinafter.

The projectile 28, 28' can maintain the highest possible weight. As shown in FIGS. 1-14, the projectile 28, 28' includes a piston 30, 30' and a main body 32, 32' such that the piston 30, 30' is received in the main body 32, 32'. The piston 30, 30' can be precision CNC machined or formed or forged and/or molded from any number of materials. For example, the piston 30, 30' can be made of tungsten, uranium, and/or molybdenum rhenium, thereby providing armor-piercing capabilities for the projectile 28, 28', and hence the cartridge 20, 20'. As a majority of the piston 30, 30' is coaxially received and/or surrounded by the main body 32, 32' when the projectile 28, 28' is within the barrel 4, 4' of the firearm 2, 2', there is no risk of the material(s) that comprise the piston 30, 30' will damage the barrel 4, 4' of the firearm 2, 2' when the projectile 28, 28' travels down through the barrel 4, 4' to subsequently exit.

Figure 16A:
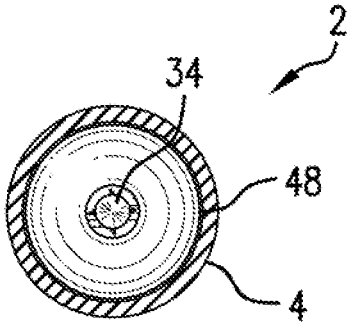
FIG. 16A is a sectional view along lines 16A-16A of FIG. 15A.
Figure 16B:
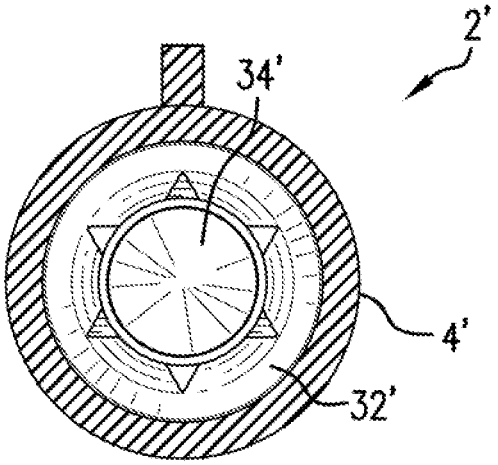
FIG. 16B is a sectional view along lines 16B-16B of FIG. 1.

Notably, the piston 30, 30' is coaxially interior and spaced from the barrel 4, 4' when the projectile 28, 28' is traveling through the barrel 4, 4' as shown in FIG. 16. It will be understood that the proportions of the individual components of the projectile 28, 28' can be adjusted based upon caliber, desired velocity, and weight of the projectile 28, 28'.

The piston 30, 30' includes a head 34, 34' and a base 36, 36' disposed at opposite ends of the piston 30, 30'. Further, the base 36, 36' defines a base diameter and includes a base circumferential surface 33, 33'. The base 36, 36' includes an exterior face 36*a*, 36*a'* and an interior face 36*b*, 36*b'* that face in opposite directions to one another so as to be parallel to one another. Stated another way, the exterior face 36*a*, 36*a'* and the interior face 36*b*, 36*b'* can be generally planar or flat so as to orthogonally intersect with the base circumferential surface 33, 33'.

Further, the exterior face 36*a*, 36*a'* of the base 36, 36' faces away from the head 34, 34', whereas the interior face 36*b*, 36*b'* faces toward the head 34, 34'. The base diameter can be constant as the base 36, 36' extends from the exterior face 36*a*, 36*a'* to the interior face 36*b*, 36*b'*. Because of the noted layout of the exterior face 36*a*, 36*a'*, the interior face 36*b*, 36*b'*, and the base circumferential surface 33, 33', there is better sealing and interaction with the main body 32 as will be described in more detail hereinafter.

The piston 30, 30' also includes a shaft 38, 38' that extends between the head 34, 34' and the base 36, 36' to connect the head 34, 34' and the base 36, 36' together. Further, the shaft 38, 38' defines a shaft diameter that can be constant as the shaft 38, 38' extends between the base 36, 36' and the head 34, 34'. It is noted that the base diameter is greater than the shaft diameter. The shaft 38, 38' can include a first portion 38*a*, 38*a'* and a second portion 38*b*, 38*b'* that cooperate to define the shaft 38, 38' to connect the base 36, 36' and the head 34, 34' with one another.

The first portion 38*a*, 38*a'* and the second portion 38*b*, 38*b'* can each define a first portion diameter and a second portion diameter that are equal to one another. Further, the head 34, 34' can define a variable head diameter that decreases as the head 34, 34' extends from the shaft 38, 38' in a direction that is away from the base 36, 36' such that the head diameter at an end of the head 34, 34' that is distal to the shaft 38, 38' is less than the shaft diameter.

As illustrated, the head 34, 34' has a conical shape (e.g., pointed) and the base 36, 36' is cylindrical. Further, the shaft 38, 38' can also be cylindrical. Additionally, the shaft 38, 38' of the piston 30, 30' is not bent or curved as it extends from the base 36, 36' to the head 34, 34' to enhance smooth movement of the piston 30, 30' within the main body 32, 32'.

As noted hereinbefore, the projectile 28, 28' includes the main body 32, 32'. The main body 32, 32' can be precision CNC machined from lead-free copper alloy. The main body 32, 32' includes a tip 40, 40' and a tail 42, 42' disposed at opposite ends of the main body 32, 32'. The main body 32, 32' also includes a rear face 32*a*, 32*a'* and a front face 32*b*, 32*b'* that face in opposite directions from one another so as to be parallel to one another. The main body 32, 32' can also define a counter-bore 52, 52' with a counter-bore circumferential surface 52*a*, 52*a'* and a through-bore 54, 54' with a through-bore circumferential surface 54*a*, 54*a'*.

The main body 32, 32' defines the counter-bore 52, 52' that extends from the tail 42, 42' toward the tip 40, 40' so as to define a piston axis 31, 31'. The counter-bore circumferential surface 52*a*, 52*a'* and the through-bore circumferential surface 54*a*, 54*a*' are both spaced from the piston axis 31, 31'. Further, the counter-bore circumferential surface 52*a*, 52*a*' remains spaced a uniform distance from the piston axis 31, 31' through an entire length of the counter-bore 52, 52'. Further still, the through-bore circumferential surface 54*a*, 54*a*' remains spaced a uniform distance from the piston axis 31, 31' through an entire length of the through-bore 54, 54'.

The projectile 28, 28' defines a non-deployed state in which the base 36, 36' is entirely received within the counter-bore 52, 52', the first portion 38*a*, 38*a*' of the shaft 38, 38' is received in the counter-bore 52, 52' and the second portion 38*b*, 38*b*' of the shaft 38, 38' is received in the through-bore 54, 54', and the head 34, 34' is received in the through-bore 54, 54'. Notably, the head 34, 34' can be entirely received in the through-bore 54, 54' as shown in FIGS. 6, 8, and 11. The projectile 28, 28' also defines a deployed state in which the base 36, 36' is entirely received within the counter-bore 52, 52', the first portion 38*a*, 38*a*' of the shaft 38, 38' and the second portion 38*b*, 38*b*' of the shaft 38, 38' are not received in the counter-bore 52, 52', and at least part of the head 34, 34' is not received in the through-bore 54, 54 such that a part of the second portion 38*b*, 38*b*' is exterior to the main body 32, 32'. In fact, it is noted that during the deployed state, that none of the head 34 is received in the through-bore 54 as shown in FIGS. 13A and 14A.

Notably, the rear face 32*a*, 32*a*' is disposed at the tail 42, 42', whereas the front face 32*b*, 32*b*' is disposed at the tip 40, 40'. The exterior face 36*a*, 36*a*' of the base 36, 36' faces in a same direction as the rear face 32*a*, 32*a*' of the main body 32, 32'. Further, the front face 32*b*, 32*b*' of the main body 32, 32' faces in a same direction of the interior face 36*b*, 36*b*' of the base 36, 36'. Further still, the rear face 32*a*, 32*a*' of the main body 32, 32' and the exterior face 36*a*, 36*a*' of the base 36, 36' are coplanar when the projectile 28, 28' is in the non-deployed state so as to be an equal distance from the tip 40, 40' along the piston axis 31, 31'. This arrangement ensures that no inadvertent materials enter the counter-bore 52, 52' and the through-bore 54, 54', thereby ensuring that proper deployment of the projectile 28, 28'. Further, the rear face 32*a*, 32*a*' of the main body 32, 32' is offset from the exterior face 36*a*, 36*a*' of the base 36, 36' when the projectile 28, 28' is in the deployed state. This offset offers numerous advantages as will be described in more detail hereinafter.

The tip 40, 40' may be a small metplat tip and the tail 42, 42' may be a tapered boat-tail. The main body 32, 32' can also include a bearing circumferential surface 48, 48' for contact with the barrel 4, 4' of the firearm 2, 2'. Further, the main body 32, 32' may define a plurality of circumferential grooves 50, 50' that reduce friction between the projectile 28, 28' and the barrel 4, 4' of the firearm 2, 2'. Overall projectile specifications of the projectile 28, 28' and the cartridge 20, 20' can conform to standard ammunition profiles for G1/G7 with aggressive a front ogive and a tapered rear boat-tail.

The counter-bore 52, 52' and the through-bore 54, 54' can be coaxially aligned with one another. Further, the counter-bore 52, 52' is in fluid communication with the through-bore 54, 54'. The counter-bore 52, 52' and the through-bore 54, 54' define a counter-bore diameter and a through-bore diameter, respectively. It is noted that the counter-bore diameter is not equal to the through-bore diameter. More particularly, the through-bore diameter can be less than the counter-bore diameter. These differences in the diameters of the counter-bore 52, 52' and the through-bore 54, 54' provide numerous advantages. For example, the extension of the piston 30, 30' is more precisely controlled, thereby ensuring that the head 34, 34' is properly located with respect to the main body 32, 32' so that the optimal aerodynamic performance is achieved.

Thus, the main body 32, 32' of the projectile 28, 28' is hollow through the center. As noted hereinbefore, the counter-bore 52, 52' extends from the tail 42, 42' toward the tip 40, 40' so as to define a piston axis 31, 31'. Notably, the shaft 38, 38' extends along the piston axis 31, 31' to connect the base 36, 36' and the head 34, 34' with one another. Further still, the through-bore 54, 54' guides the piston 30, 30' towards the tip 40, 40' of the projectile 28, 28'. Because of the coaxial nature of the counter-bore 52, 52' and the through-bore 54, 54', the main body 32, 32' defines a shoulder 56, 56'. The shoulder 56, 56' is located at a junction between the counter-bore 52, 52' and the through-bore 54, 54'.

The through-bore 54, 54' primarily receives the head 34, 34' and the shaft 38, 38' of the piston 30, 30', whereas the counter-bore 52, 52' primarily receives the base 36, 36'. Notably, the base 36, 36' does not extend into the through-bore 54, 54' in either the non-deployed or deployed state. Further, the interior face 36*b*, 36*b*' of the base 36, 36' is spaced from the shoulder 56, 56' in the non-deployed state and the interior face 36*b*, 36*b*' of the base 36, 36' directly contacts the shoulder 56, 56' in the deployed state. Because of this arrangement, inadvertent material (e.g., the propellant 26, 26') is prevented from entering the counter-bore 52, 52' when the projectile 28, 28' is in the non-deployed state. Additionally, the counter-bore circumferential surface 52*a*, 52*a*' can directly contact the base circumferential surface 33, 33' during both the non-deployed state and the deployed state. Because of this, the piston 30, 30' is smoothly guided within the main body 32, 32' as the projectile 28, 28' transitions from the non-deployed state to the deployed state. Further still, due to the direct contact between the interior face 36*b*, 36*b*' of the base 36, 36' and the shoulder 56, 56', aerodynamic stability of the piston 30, 30' is improved.

When the projectile 28, 28' is in the non-deployed state (FIGS. 6-11), the rear face 32*a*, 32*a*' of the main body 32, 32' and the exterior face 36*a*, 36*a*' of the base 36, 36' of the piston 30, 30' are aligned so as to be flush with one another and the interior face 36*b*, 36*b*' is spaced or offset from the shoulder 56, 56'. The head 34, 34' is thus disposed inside of the through-bore 54, 54' of the main body 32, 32' so as to protect and prevent damage to the piston 30, 30'. The piston 30, 30' can be precisely machined with close tolerance with respect to the through-bore 54, 54' as to allow for a press/friction fit in the non-deployed state and deployed state.

Because of the counter-bore 52, 52', the piston 30, 30' may be seated inside of the main body 32, 32' after firing to control the length at which the head 34, 34' is extended through the tip 40, 40'. The counter-bore 52, 52' and the through-bore 54, 54' can provide weight reduction to the projectile 28, 28'. Further, because of the structure of the projectile 28, 28' of the present disclosure, high velocities with equal or much greater energy transfer/terminal performance to the target at the time of impact with the target can be provided, as compared to a traditional projectile.

The counter-bore 52, 52' and shoulder 56, 56', in cooperation with the piston 30, 30', can provide a press fit tolerance to allow for a solid friction fit when the piston 30, 30' is projected forward in the main body 32, 3Z. Thus, the piston 30, 30' does not loosely slide within the main body 32, 32' in the deployed or non-deployed state. As will be appreciated, this is desirable so that the piston 30, 30' is always properly located with respect to the main body 32, 32'. The counter-bore 52, 52' becomes a pressure chamber/cavity for a buildup of pressure once the piston 30, 30' advances with respect to the main body 32, 32'. Further, because of the dimensional relationship between the diameter of the through-bore 54, 54' and the diameter of the shaft 38, 38' of the piston 30, 30', no crimping is needed. Additionally, the tip 40, 40' supports the piston 30, 30' with no premature deformation of the piston 30, 30' and the main body 32, 32' in the non-deployed state and deployed state. Rather, deformation of the piston 30, 30' and main body 32, 32' does not occur until the projectile 28, 28' impacts the target.

FIGS. 12-16 shows the projectile 28, 28' after firing and before leaving the barrel of the firearm. Thus, when the cartridge 20, 20' is fired, the piston 30, 30' is driven forward with respect to the main body 32, 32', After firing, the piston 30, 30' is moved forward inside of the main body 32, 32' until the piston 30, 30' becomes seated on (e.g., directly contacts) the shoulder 56, 56' of the main body 32, 32'. Because of this direct contact, the piston 30, 30', is properly positioned with respect to the main body 32, 32' and improved aerodynamic performance of the projectile 28, 28' is achieved.

As illustrated, the counter-bore 52, 52 defines a larger volume than the volume of the base 36, 36'. This is due to the counter-bore 52, 52' having a longer length than the base 36, 36'. As such, the exterior face 36*a*, 36*a*' of the base 36, 36' is seated into and beyond (e.g., offset from) the rear face 32*a*, 32*a*' of the main body 32, 32', therefore creating an open chamber and/or air gap. This allows for more surface area for escaping gases thereby enhancing aerodynamic performance of the projectile 28, 28'.

Thus, at least part of the head 34, 34' of the piston 30, 30' extends beyond the tip 40, 40'. Thus, when in the deployed state, at least part of the head 34, 34' and, optionally, at least part of the shaft 38, 38' extend from the tip 40, 40'. The length of the head 34, 34' and shaft 38, 38' can be controlled depending on caliber and projectile function. Thus, a portion of the piston 30, 30' extends by a tuned certain percentage of the overall length of the projectile 28, 28' based on weight and caliber. This allows for a more aerodynamic shape that provides reduced drag and increased velocity at greater distances. Further, the piston 30, 30' can be manufactured from any number of materials based upon application and desired objectives.

A portion of the piston 30, 30' extends past the ogive/curvature at the tip 40, 40' of the main body 32, 32' of the projectile 28, 28'. As shown in FIGS. 12A, 13A, and 14A, the piston 30 can be of such a length such that the angle of the head 34 of the piston 30 is angularly aligned with a point 72 of an ogive portion 70 to finish the ogive profile to define the deployed state. The streamlined main body 32 and extended head 34 causes the engagement of air flow at different points along its axis depending on the % of tip length as it relates to the OAL and weight of the projectile 28. It will be appreciated that if the piston 30, 30' was too long and the piston 30, 30' extended from the main body 32, 32' at too great of a distance, that stability and accuracy of the projectile 28, 28' would be negatively impacted.

The main body 32, 32' can also define a plurality of channels 58, 58' that longitudinally extend from the front face 32*b*, 32*b*' toward the shoulder 56, 56'. Further, the longitudinal channels 58, 58' can be disposed in a radially equal manner about the through-bore 54, 54' so as to be in fluid communication with the through-bore 54, 54'. As will be described in more detail hereinafter, these channels 58, 58' can aid in separation of the main body 32, 32' into multiple pieces when the projectile 28, 28' strikes an object.

As shown in FIGS. 1A, 4A, 6A, 9A, and 12A, there can be four longitudinal channels 58, 58' disposed in a radially uniform manner (i.e., 90 degrees of separation between each channel when viewed from the front). However, as shown in FIGS. 1B, 4B, 6B, 9B, and 12B, there can be six longitudinal channels 58, 58' disposed in a radially uniform manner (i.e., 60 degrees of separation between each channel).

The channels 58, 58' can be of a uniform depth as they extend from the front face 32*b*, 32*b*' toward the shoulder 56, 56' (i.e., each channel has a same depth as the other channels). The channels 58, 58' may extend from the front face 32*b*, 32*b*' toward the shoulder 56, 56' from a depth of nearly zero to several hundred thousandths of an inch without departing from the scope of this disclosure. As such, since an exterior surface of the main body 32, 32' at least partially curves inward when laterally extending from the circumferential grooves 50, 50' to the front face 32*b*, 32*b*', the main body 32, 32' defines a plurality of petals 60, 60'. As shown in FIGS. 1A, 4A, 6A, 9A, and 12A, there can be four petals 60, 60'. However, as shown in FIGS. 1B, 4B, 6B, 9B, and 12B, there can be six petals 60, 60'.

The channels 58, 58' extending through to the through-bore 54, 54' and the interaction between the main body 32, 32' and the piston 30, 30' provide the main body 32, 32' with the ability to fragment upon hitting a soft target. For example, the main body 32, 32' can split along these channels 58, 58' due to hydrostatic energy causing the projectile 28, 28' to dump all potential energy into the target, while not over-travelling beyond an initial desired impact zone. The channels 58, 58' help to facilitate the projectile 28, 28' to split into many sections within three to sixteen inches of penetration. Further, the projectile 28, 28' can be designed to expand depending on the type of the material composition of the projectile 28, 28. Notably, the projectile 28, 28' could be made of a fragmenting material or an expanding material. This material could be, for example, copper. Further still, the continued forward movement of the piston 30, 30' can create many more separate fragments of the piston 30, 30' and the main body 32, 32'. Notably, the channels 58, 58', independent of location, can aid in fragmentation of the projectile 28, 28' after impact with the target.

By being able to control and increase the overall length of a projectile 28, 28' after firing, flight characteristics can be altered by reducing aerodynamic drag at supersonic and subsonic speeds. For example, the piston 30, 30' creates a detached shock ahead of the main body 32, 32', thereby allowing the main body 32, 32' to be more streamlined, even with non-typical projectile profiles.

The design of the projectile 28, 28' maximizes lethality by transferring all potential energy within the first three to sixteen inches of a soft tissue target without any potential for over travel beyond the initial target. This phenomenon is present even in higher caliber cartridges 20 such as 7.62 NATO/0.308 Win and .50 caliber. Further, the projectile 28, 28' can fragment into four or more sharp edged shards that rapidly slow after impact, but continue to cut into soft tissue as it slows. Further still, the projectile 28, 28' can be designed to maintain the highest possible singular weight to maximize expansion to increase terminal performance.

Thus, devastating wound channels in ballistics gel (16' standard FBI block) occur. Further, all shards were recoverable in the ballistics gel. Ballistics testing of the projectile 28, 28' include ballistic coefficient data and wound cavity gel testing. The projectile 28, 28' exhibits reduced drag, higher energy (after leaving the barrel 4, 4' and on impact), and incapacitating wound channels without projectile over travel.

As shown in FIGS. 11A, 12A, 13A, and 14A, the main body 32 also includes a boat-tail portion 62 with a boat-tail circumferential surface 64, a bearing portion 66 with the bearing circumferential surface 48, and an ogive portion 70 with a point 72. The bearing portion 66 is linearly disposed between the boat-tail portion 62 and the ogive portion 70. The boat-tail portion 62 defines a boat-tail diameter with the boat-tail circumferential surface 64 facing radially outward from the piston 30. Further, the bearing portion 66 defines a bearing diameter with the bearing circumferential surface 48 facing radially outward from the piston 30. The bearing portion 66 extends from a junction with the boat-tail portion 62 toward the tip 40 of the main body 32. As shown in FIGS. 6 and 16, the bearing circumferential surface 48, 48' is configured to contact with an inner diameter of the associated barrel 4, 4' of the associated firearm 2, 2'.

With continued attention to FIGS. 11A, 12A, 13A, and 4A, the ogive portion 70 defines an ogive diameter that faces outward from the piston 30 and decreases in diameter when extending from a junction with the bearing portion 66 to the tip 40 of the main body 32. A cross section of the projectile 28 along which the piston axis 31 resides is a surface of revolution 35 of the head 34 that defines at least one line 35*a*. The point 72 of the ogive portion 70 is situated along the at least one line 35*a* when the projectile 28 is in the deployed state. Thus, the head 34 is external to the main body 32 when the projectile 28 is in the deployed state such that the head 34 is not received within any part of the main body 32. This layout of the piston 30 and the main body 32 provides better stability of the projectile 28 during flight.

The point 72 of the ogive portion 70 that is situated along the at least one line 35*a* when the projectile 28 is in the deployed state can be at least as long as a diameter of the shaft 38 of the piston 30. Further, the boat-tail diameter increases in diameter when extending from the rear face 32*a* toward the tip 40 of the main body 32 along the piston axis 31. The aforementioned arrangement allows for improved aerodynamic performance of the projectile 28.

The described projectile 28, 28' can be used in any caliber and type of ammunition from personal defense handgun rounds to military specific sniper rounds. The cartridge 20, 20' with the projectile 28, 28' can dispatch wild game, but also save lives in an urban police situation, as the risk of over-penetration of the projectile 28, 28' is dramatically reduced. The projectile 28, 28' is compatible with all types of firearms and can be modified to fit many specific applications.

The projectile 28, 28' does not increase drag nor is it inferior to standard OTS ballistics data. The projectile 28, 28' maintains better aerodynamic shape and flight due to the movable piston 30, 30'. Because the head 34, 34' of the piston 30, 30' can be pointed and shifts toward the front face 32*b*, 32*b'*, the projectile 28, 28' becomes more aerodynamic than that of conventional ball or hollow point geometries while increased energy dump is achieved at a more shallow depth and impact to the target.

The projectile 28, 28' is disposed, dimensioned and structured to define the primary area of contact of the main body 32, 32' with the rifling or interior surface of the barrel of the firearm. Upon firing, the piston 30, 30' is driven through the main body 32, 32' and seated to allow the overall length of the projectile 28, 28' to be optimized for improved flight characteristics including reduced drag, higher energy, and more accuracy. Upon striking soft tissue or like material target, the main body 32, 32' and piston 30, 30' allow the projectile 28, 28' to fully fragment or expand allowing it to unload all of its potential energy without over penetration.

A projectile and cartridge have been described above with particularity. Modifications and alterations will occur to those upon reading and understanding the preceding detailed description. The invention, however, is not limited to only the embodiments described above. Instead, the invention is broadly defined by the appended claims and the equivalents thereof.

The invention claimed is:

1. A projectile, comprising:

a main body including a tip and a tail disposed at opposite ends of the main body, the main body defining a counter-bore extending from the tail toward the tip so as to define a piston axis and a through-bore extending from the tip toward the tail along the piston axis, wherein the counter-bore defines a counter-bore diameter and a counter-bore length and the through-bore defines a through-bore diameter and a through-bore length, the counter-bore diameter not being equal to the through-bore diameter; and a piston received in the main body, the piston including a base and a head disposed at opposite ends thereof, the piston also including a shaft with a first portion and a second portion that cooperate to connect the base and the head with one another, wherein the through-bore length is greater than the counter-bore length so that the projectile defines a non-deployed state in which the base is entirely received within the counter-bore, the first portion of the shaft is received in the counter-bore and the second portion of the shaft is received in the through-bore, and the head is received in the through-bore, and a deployed state in which the base is entirely received within the counter-bore, the first portion of the shaft and the second portion of the shaft are not received in the counter-bore, and at least part of the head is not received in the through-bore.

2. The projectile of claim 1, wherein the through-bore diameter is less than the counter-bore diameter, wherein the first portion defines a first portion diameter and the second portion defines a second portion diameter, and wherein the first portion diameter is equal to the second portion diameter.

3. The projectile of claim 1, wherein the counter-bore and the through-bore are coaxial with one another and the counter-bore is in fluid communication with the through-bore, and wherein the shaft linearly extends along the piston axis to connect the base and the head with one another.

4. The projectile of claim 1, wherein the base defines a base diameter and the shaft defines a shaft diameter, and wherein the base diameter is greater than the shaft, diameter.

5. The projectile of claim 4, wherein the head defines a variable head diameter that decreases as the head extends from the shaft in a direction that is away from the base such that the head diameter at an end of the head that is distal to the shaft is less than the shaft diameter.

6. The projectile of claim 4, the base including an exterior face that faces in a direction that is opposite to the head and an interior face that faces toward the head, wherein the base diameter is constant as the base extends from the exterior face to the interior face and the shaft diameter is constant as the shaft extends between the base and the head.

7. The projectile of claim 4, wherein the base includes a base circumferential surface that contacts a counter-bore circumferential surface when the projectile is in the non-deployed state and in the deployed state.

8. The projectile of claim 1, the base including an exterior face and an interior face, the exterior face and the interior face facing in opposite directions from one another so as to be parallel to one another.

9. The projectile of claim 8, the main body including a rear face and a front face that face in opposite directions from one another so as to be parallel to one another, wherein the exterior face of the base faces in a same direction as the rear face of the main body and the front face of the main body faces in a same direction of the interior face of the base.

10. The projectile of claim 9, the rear face of the main body and the exterior face of the base are coplanar when the projectile is in the non-deployed state so as to be an equal distance from the tip along the piston axis and the rear face of the main body is offset from the exterior face of the base when the projectile is in the deployed state.

11. The projectile of claim 8, wherein the main body defines a shoulder disposed at a junction between the counter-bore and the through-bore, and wherein the interior face of the base is spaced from the shoulder in the non-deployed state and the interior face of the base directly contacts the shoulder in the deployed state.

12. The projectile of claim 1, wherein the counter-bore defines a counter-bore volume and the through-bore defines a through-bore volume, and wherein the counter-bore volume is greater than the through-bore volume.

13. The projectile of claim 1, the main body including a boat-tail portion, an ogive portion, and a bearing portion linearly disposed therebetween;

wherein the boat-tail portion defines a boat-tail diameter with a boat-tail circumferential surface that faces radially outward from the piston;

wherein the bearing portion defines a bearing diameter with a bearing circumferential surface that faces radially outward from the piston, the bearing portion extending from a junction with the boat-tail portion toward the tip of the main body, the bearing circumferential surface configured to contact with an associated inner diameter of an associated barrel of an associated firearm;

wherein the ogive portion defines an ogive diameter that faces outward from the piston and decreases in diameter when extending from a junction with the bearing portion to the tip of the main body, and wherein a cross section of the projectile along which the piston axis resides is a surface of revolution of the head that defines at least one line and a point of the ogive portion is situated along the at least one line when the projectile is in the deployed state.

14. The projectile of claim 13, wherein the point of the ogive portion that is situated along the at least one line when the projectile is in the deployed state is at least as long as a diameter of the shaft of the piston.

15. The projectile of claim 13, wherein the boat-tail diameter increases in diameter when extending from the rear face toward the tip of the main body along the piston axis.

16. The projectile of claim 1, wherein the main body defines a plurality of channels that longitudinally extend along the through-bore so as to be in fluid communication with the through-bore.

17. The projectile of claim 1, wherein the head is, external to the main body when the projectile is in the deployed state such that the head is not received within any part of the main body.

18. The projectile of claim 1, wherein the head is entirely received in the through-bore when the projectile is in the non-deployed state, and wherein the first portion of the shaft is entirely received in the through-bore when the projectile is in the deployed state and the second portion of the shaft is only partially received in the through-bore when the projectile is in the deployed state such that a part of the second portion is exterior to the main body.

19. The projectile of claim 1, wherein all parts the head are not within the through-bore in the deployed state and are forward of the tip.

20. A cartridge, comprising:

a case including a first end and a second end;

a primer disposed in the case at the first end;

propellant disposed in the case between the primer and the second end; and a projectile at least partially received in the case at the second end, the projectile including a main body with a tip and a tail disposed at opposite ends of the main body, the main body defining a counter-bore extending from the tail toward the tip so as to define a piston axis and a through-bore extending from the tip toward the tail along the piston axis, wherein the counter-bore defines a counter-bore diameter and a counter-bore length and the through-bore defines a through-bore diameter and a through-bore length, the counter-bore diameter not being equal to the through-bore diameter, and a piston received in the main body, the piston including a base and a head disposed at opposite ends thereof, the piston also including a shaft with a first portion and a second portion that cooperate to connect the base and the head with one another, wherein the through-bore length is greater than the counter-bore length so that the projectile defines a non-deployed state in which the base is entirely received within the counter-bore, the first portion of the shaft is received in the counter-bore and the second portion of the shaft is received in the through-bore, and the head is received in the through-bore, and a deployed state in which the base is entirely received within the counter-bore, and at least part of the head is not received in the through-bore.

* * * * *